US008864502B2

(12) United States Patent
Dinh

(10) Patent No.: US 8,864,502 B2
(45) Date of Patent: Oct. 21, 2014

(54) MECHANICAL GROUNDING CONNECTOR

(71) Applicant: Thomas & Betts International, Inc., Wilmington, DE (US)

(72) Inventor: Cong T. Dinh, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 36 days.

(21) Appl. No.: 13/773,188

(22) Filed: Feb. 21, 2013

(65) Prior Publication Data

US 2013/0295786 A1 Nov. 7, 2013

Related U.S. Application Data

(60) Provisional application No. 61/642,518, filed on May 4, 2012.

(51) Int. Cl.

| | |
|---|---|
| ***H01R 24/30*** | (2011.01) |
| ***H01R 4/64*** | (2006.01) |
| ***H01R 4/46*** | (2006.01) |

(52) U.S. Cl.

CPC ..... *H01R 24/30* (2013.01); *H01R 4/64* (2013.01); *H01R 4/46* (2013.01)

USPC ..... 439/97

(58) Field of Classification Search

USPC ..... 439/100, 97, 781, 804, 792, 398, 388

See application file for complete search history.

(56) References Cited

U.S. PATENT DOCUMENTS

| | | | | | |
|---|---|---|---|---|---|
| 667,530 | A | * | 2/1901 | Johnson | 403/398 |
| 1,781,458 | A | * | 11/1930 | Gore | 403/388 |
| 2,712,167 | A | * | 7/1955 | Blanchard | 24/569 |
| 3,248,684 | A | * | 4/1966 | Hubbard et al. | 439/431 |
| 3,794,963 | A | | 2/1974 | Cooper, Jr. | |
| 3,892,455 | A | | 7/1975 | Sotolongo | |
| 3,988,052 | A | * | 10/1976 | Mooney et al. | 439/804 |
| 4,131,257 | A | * | 12/1978 | Sterling | 248/67.5 |
| 4,440,519 | A | | 4/1984 | Pennel et al. | |
| 4,456,326 | A | | 6/1984 | Sauber | |
| 4,475,843 | A | | 10/1984 | Wyler | |
| 4,526,428 | A | | 7/1985 | Sachs | |
| 4,863,390 | A | * | 9/1989 | Cera et al. | 439/100 |
| 4,985,003 | A | * | 1/1991 | Francois et al. | 439/781 |
| 5,171,169 | A | | 12/1992 | Butcher et al. | |
| 5,286,211 | A | | 2/1994 | McIntosh | |

(Continued)

FOREIGN PATENT DOCUMENTS

| | | |
|---|---|---|
| CA | 2111608 | 7/1994 |
| CA | 2309965 | 6/1999 |

(Continued)

*Primary Examiner* — Alexander Gilman

(74) *Attorney, Agent, or Firm* — Robbie Elaine Webb

(57) ABSTRACT

A mechanical grounding connector is provided for connecting at least two conductors. The connector is comprised of a first, second and third body section which have channels that allow for installation of conductors between each of the body sections. The channels of each body section lie at 90 degree angles such that conductors can be installed in a parallel or transverse arrangement. Bolts are used to hold together the first, second and third body sections of the connector and allow the body sections to be separated from one another by loosening the bolts to install conductors, without the need to completely remove the bolts from the connector.

24 Claims, 11 Drawing Sheets

(56) References Cited

U.S. PATENT DOCUMENTS

| | | | | |
|---|---|---|---|---|
| 5,376,090 | A * | 12/1994 | Pennig | 606/54 |
| 5,692,930 | A * | 12/1997 | Garver et al. | 439/781 |
| 5,752,860 | A * | 5/1998 | Greaves | 439/781 |
| 5,848,913 | A | 12/1998 | Ashcraft | |
| 5,919,065 | A | 7/1999 | Warner et al. | |
| 5,934,818 | A * | 8/1999 | Schmitt et al. | 403/399 |
| 6,241,563 | B1 | 6/2001 | Warner et al. | |
| 6,325,678 | B1 * | 12/2001 | Auclair | 439/803 |
| 6,390,861 | B1 * | 5/2002 | DeFrance | 439/783 |
| 6,494,726 | B1 * | 12/2002 | Auclair | 439/92 |
| 6,579,032 | B1 | 6/2003 | Ledingham | |
| 6,786,672 | B2 | 9/2004 | Ledingham | |
| 6,909,049 | B2 | 6/2005 | DiTroia | |
| 6,945,729 | B2 * | 9/2005 | Yasuda | 403/408.1 |
| 6,976,857 | B1 * | 12/2005 | Shukla et al. | 439/100 |
| 7,241,074 | B2 * | 7/2007 | Thomke et al. | 403/385 |
| 7,387,546 | B2 * | 6/2008 | Copper et al. | 439/781 |
| D576,464 | S * | 9/2008 | Franks, Jr. | D8/72 |
| 7,537,467 | B1 | 5/2009 | Gretz | |
| 7,862,390 | B2 | 1/2011 | Copper | |
| 7,997,943 | B2 * | 8/2011 | Gregory et al. | 439/782 |
| 8,523,858 | B2 * | 9/2013 | Lessig et al. | 606/54 |
| 2002/0037193 | A1 * | 3/2002 | Gibbons et al. | 403/344 |
| 2003/0216079 | A1 | 11/2003 | Bonilla et al. | |
| 2006/0287652 | A1 * | 12/2006 | Lessig et al. | 606/54 |
| 2007/0038217 | A1 * | 2/2007 | Brown et al. | 606/57 |
| 2007/0167087 | A1 | 7/2007 | Hay et al. | |
| 2007/0270046 | A1 * | 11/2007 | Copper et al. | 439/781 |
| 2008/0283686 | A1 | 11/2008 | Copper | |
| 2009/0075499 | A1 * | 3/2009 | Szu | 439/68 |
| 2010/0003846 | A1 | 1/2010 | Diniz et al. | |
| 2010/0221934 | A1 | 9/2010 | Robicheau et al. | |
| 2010/0221935 | A1 | 9/2010 | Rzasa et al. | |
| 2011/0065333 | A1 | 3/2011 | Ruland | |
| 2011/0084186 | A1 * | 4/2011 | Ehrhardt et al. | 248/201 |
| 2011/0151703 | A1 | 6/2011 | Lawson et al. | |
| 2012/0088380 | A1 * | 4/2012 | Smith | 439/100 |
| 2013/0295786 | A1 * | 11/2013 | Dinh | 439/97 |
| 2014/0030933 | A1 * | 1/2014 | Wiegmann et al. | 439/767 |

FOREIGN PATENT DOCUMENTS

| | | |
|---|---|---|
| CA | 2573750 | 7/2007 |
| CA | 2611213 | 6/2008 |
| CA | 2703937 | 5/2009 |
| CA | 2647889 | 7/2009 |
| CA | 2692105 | 8/2010 |
| CA | 2692141 | 8/2010 |
| CA | 2765944 | 1/2011 |
| CA | 2714528 | 3/2011 |
| CA | 2725879 | 6/2011 |
| CA | 2428894 | 7/2011 |
| CA | 2630244 | 7/2011 |
| CA | 2683284 | 2/2012 |
| CA | 2685765 | 2/2012 |
| CA | 2755480 | 4/2012 |
| WO | WO2010002556 | 1/2010 |
| WO | WO2013004343 | 1/2013 |

* cited by examiner

MECHANICAL GROUNDING CONNECTOR

CROSS-REFERENCE TO RELATED APPLICATION

This application claims priority under 35 U.S.C. §119, based on U.S. Provisional Patent Application No. 61/642,518, filed May 4, 2012, the disclosure of which is hereby incorporated by reference herein.

FIELD OF THE INVENTION

In general, the present invention relates to a mechanical grounding connector for conductors which allows conductors to be installed either parallel or transversely to one another and which allows for conductors to be installed without welding or the use of special tools.

BACKGROUND

Currently, the only grounding connectors for conductors which are rated to meet IEEE standards are exothermic connectors and compression connectors. Exothermic connectors require welding. Compression connectors can also be inconvenient to use, as they require the use of special tools for installation. A grounding connector is needed which is easy and safe to use and which does not require the use of special instruments or tools.

SUMMARY OF THE INVENTION

The present invention provides a mechanical grounding connector for conductors that is rated to meet IEEE requirements and which does not require exothermic or compression means for installation of the conductors. The mechanical grounding connector is easy to use and provides for quick installation of conductors without the requirement of welding or the use of special tools. Two bolts are used to hold together the multiple parts of the mechanical grounding connector, and conductors can be quickly installed without completely removing the bolts from the connector, which allows for the multiple parts of the connector to be held together even when the bolts are loosened. Conductors may be installed in the mechanical grounding connector in a parallel or transverse arrangement for a variety of applications, including above ground and underground applications.

DETAILED DESCRIPTION OF THE PREFERRED EMBODIMENT(S)

Figure 1:
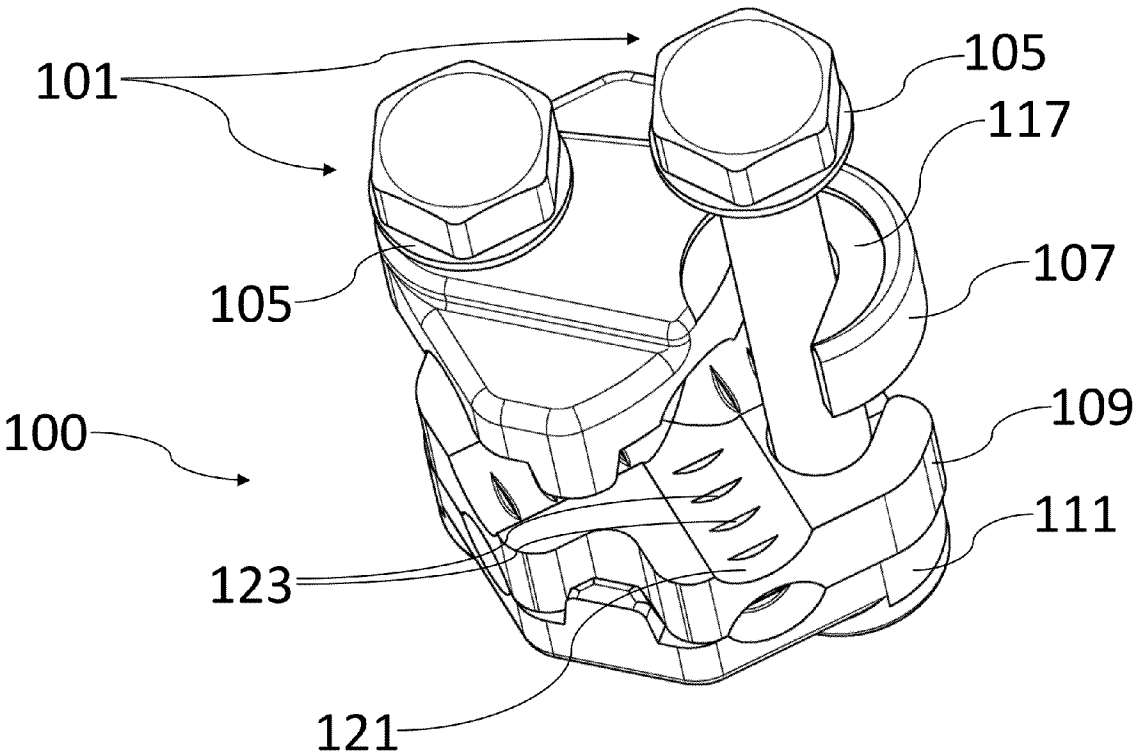
FIG. 1 is a top front perspective view of the mechanical grounding connector of the present invention.

The above and other features, aspects and advantages of the present invention will now be discussed in the following detailed description of preferred embodiments and appended claims, which are to be considered in conjunction with the accompanying drawings in which identical reference characters designate like elements throughout the views.

Figure 2:
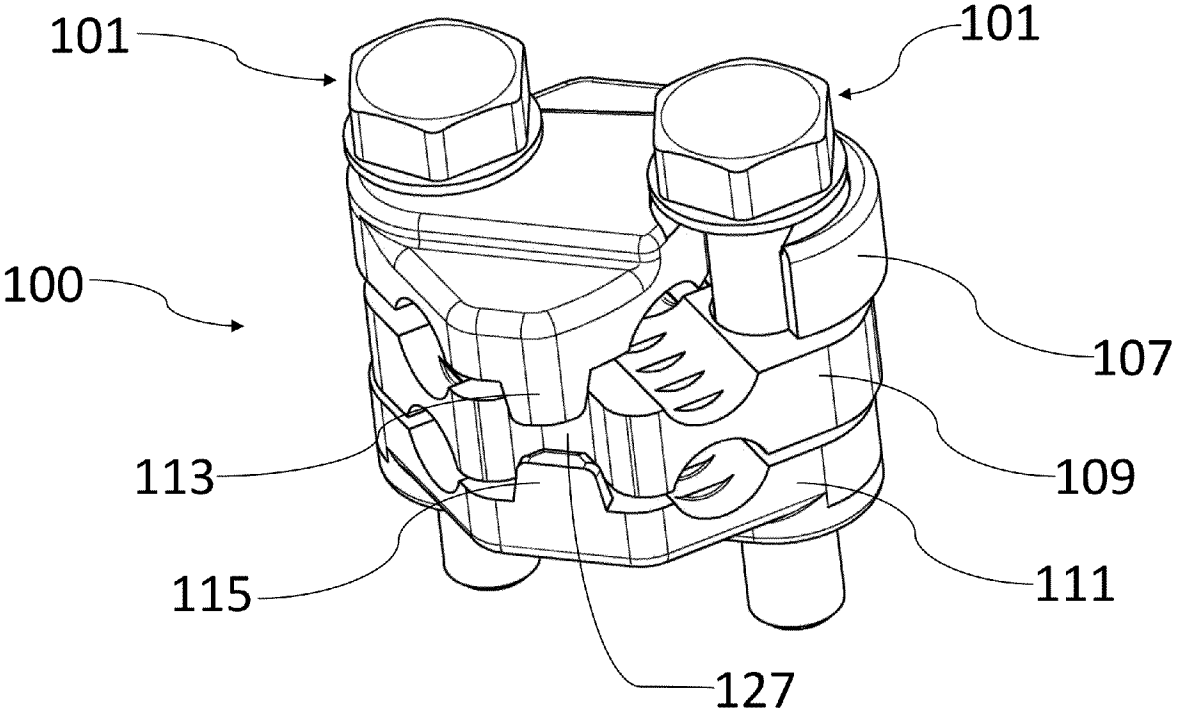
FIG. 2 is a side front perspective view of the mechanical grounding connector of the present invention.
Figure 3:
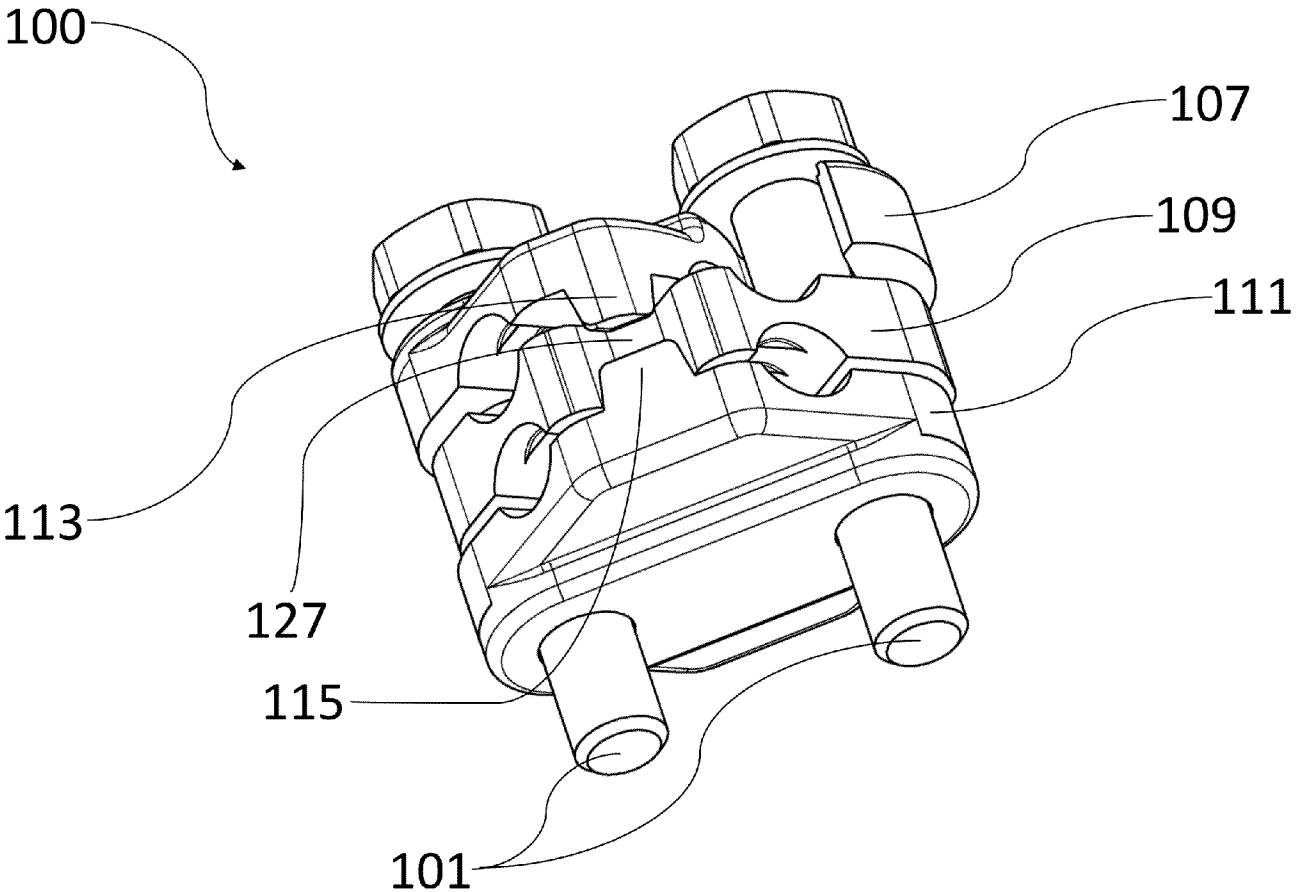
FIG. 3 is a bottom front perspective view of the mechanical grounding connector of the present invention.

FIGS. 1-3 show varying front perspective views of the mechanical grounding connector 100 of the present invention. In general, the connector comprises a first body section 107, a second body section 109, and a third body section 111, which are held together by bolts 101 and washers 105. It is preferred that the bolts 101 be made from stainless steel for strength purposes and that the body sections be made from silicon bronze in order to promote conductivity and in order to meet IEEE standards, however, it is understood that different materials may be substituted in place of these. As is shown in the exploded front perspective views of the mechanical grounding connector in FIGS. 4 and 5, each of the body sections contains apertures 120 or slots 119 to receive the bolts 101. When the apertures 120 or slots 119 of the first body section 107, second body section 109, and third body section 111 are aligned, the bolts 101 can be simultaneously received through the apertures 120 or slots 119 of each body section to form the mechanical grounding connector 100.

Figure 5:
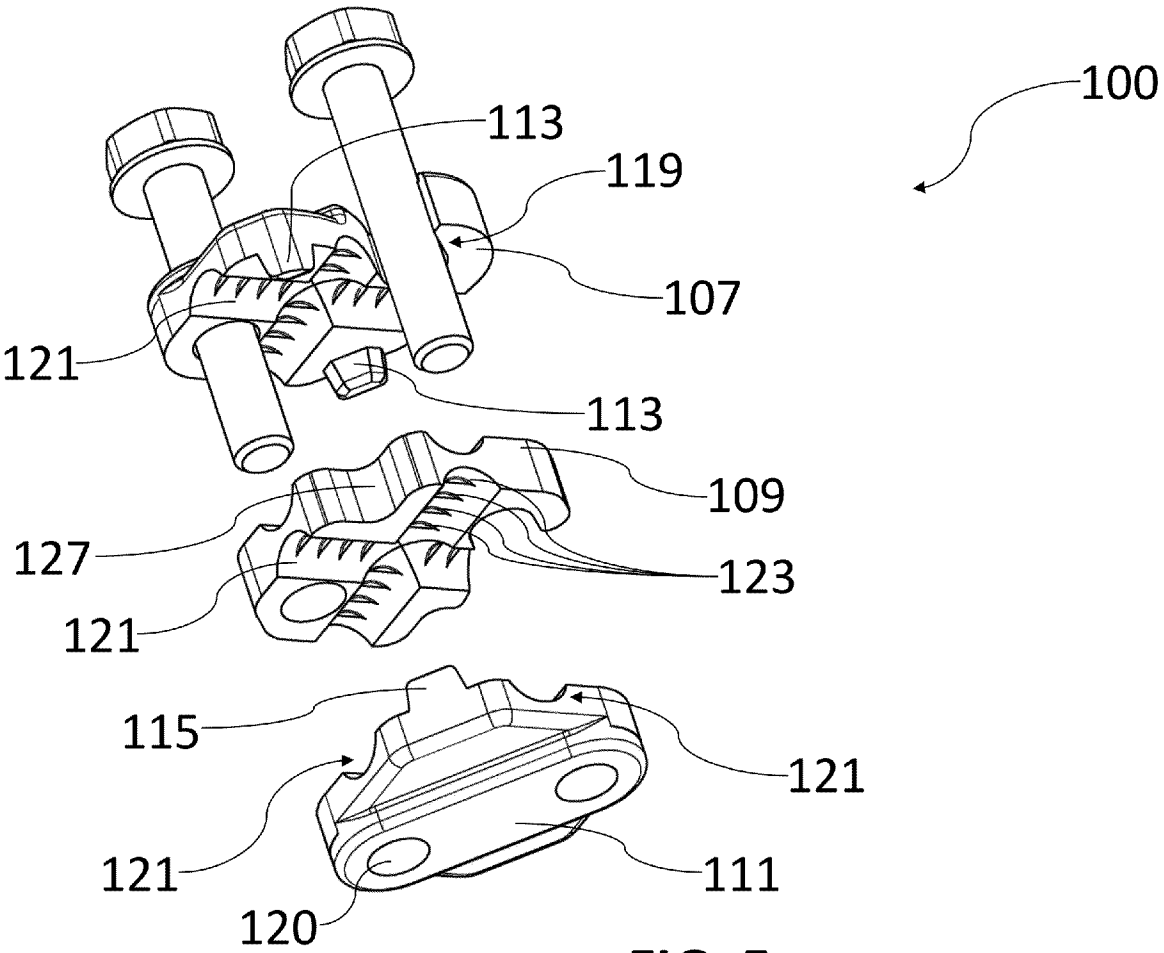
FIG. 5 is an exploded bottom front perspective view of the mechanical grounding connector of the present invention.
Figure 6:
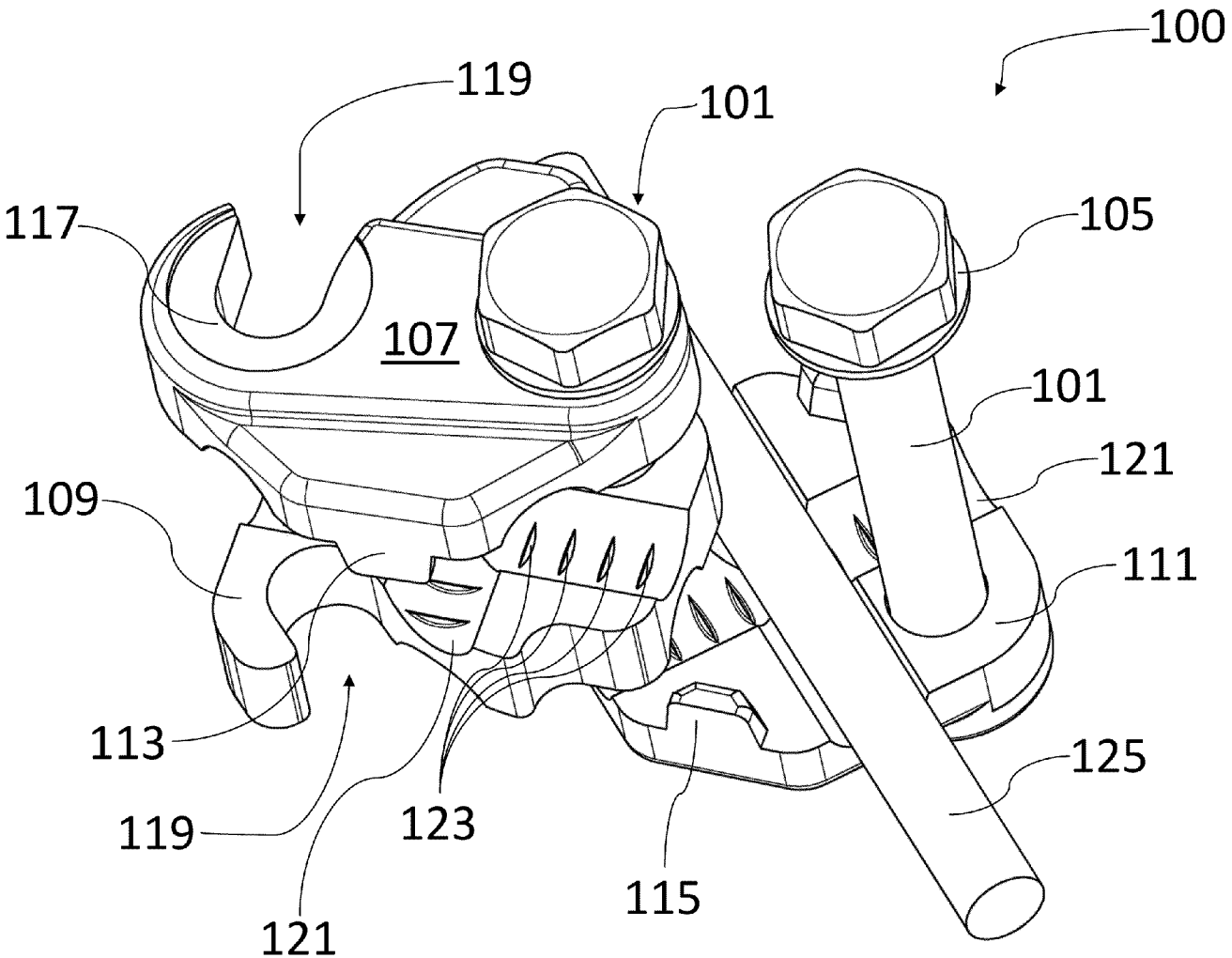
FIG. 6 is a top perspective view of the mechanical grounding connector of the present invention in the open position with a cable being installed.

In FIG. 6, the mechanical grounding connector 100 is shown in the open position such that conductors 125 can be installed. The open position of the connector 100 is achieved by loosening the bolts 101 with a wrench. It can be seen from FIGS. 6 and 7 that the bolts 101 are not required to be removed in order for the first body section 107, second body section 109 and third body section 111 to be separated to allow for installation of the conductors 125. When the bolts 101 are loosened, one of the bolts acts as an axis about which the three body sections are able to rotate. The bolt which acts as the axis is that same bolt which has been received through the apertures 120, rather than the slots 119, of the body sections, as is shown in the exploded views of the connector in FIGS. 4 and 5.

Figure 4:
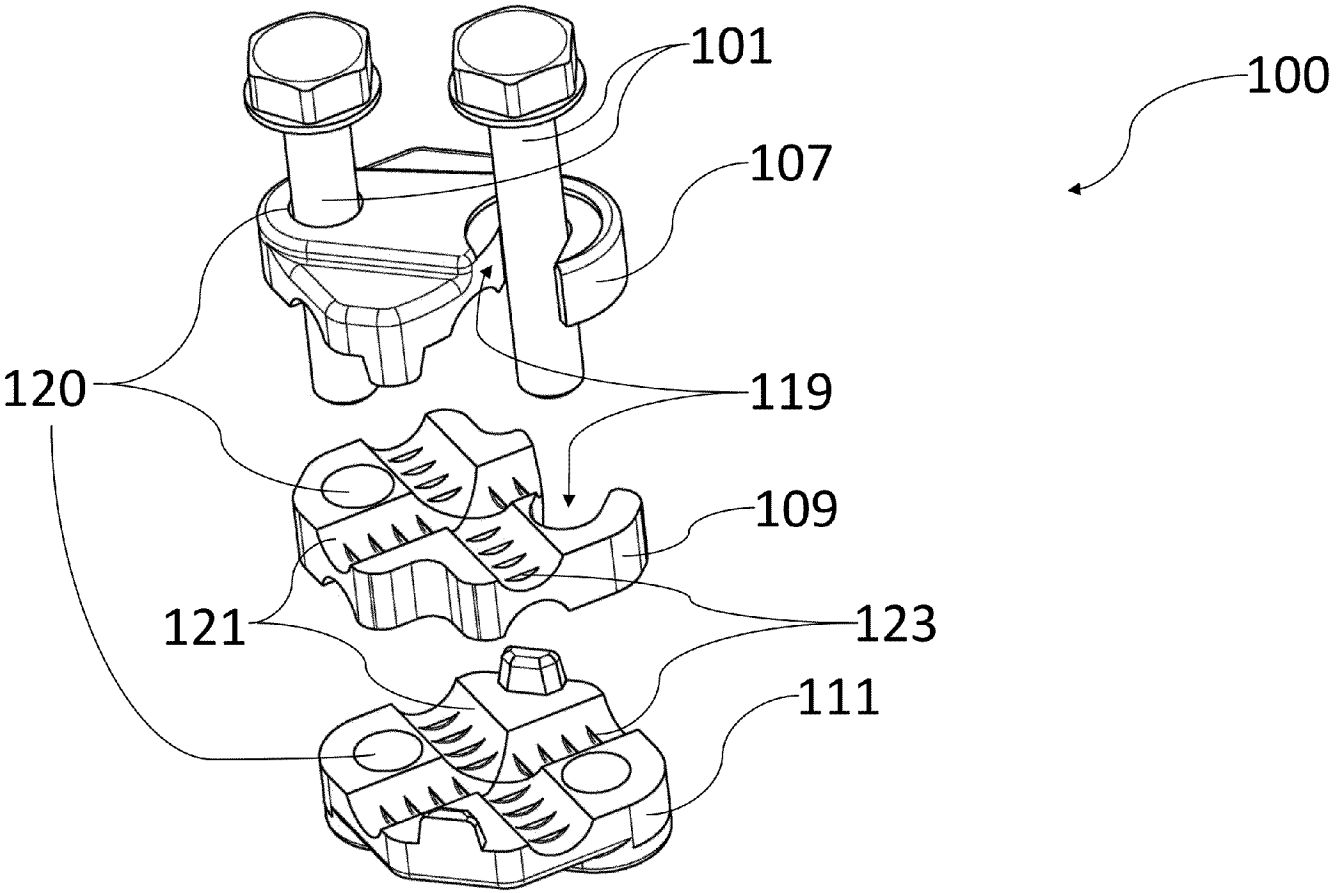
FIG. 4 is an exploded top front perspective view of the mechanical grounding connector of the present invention.
Figure 7:
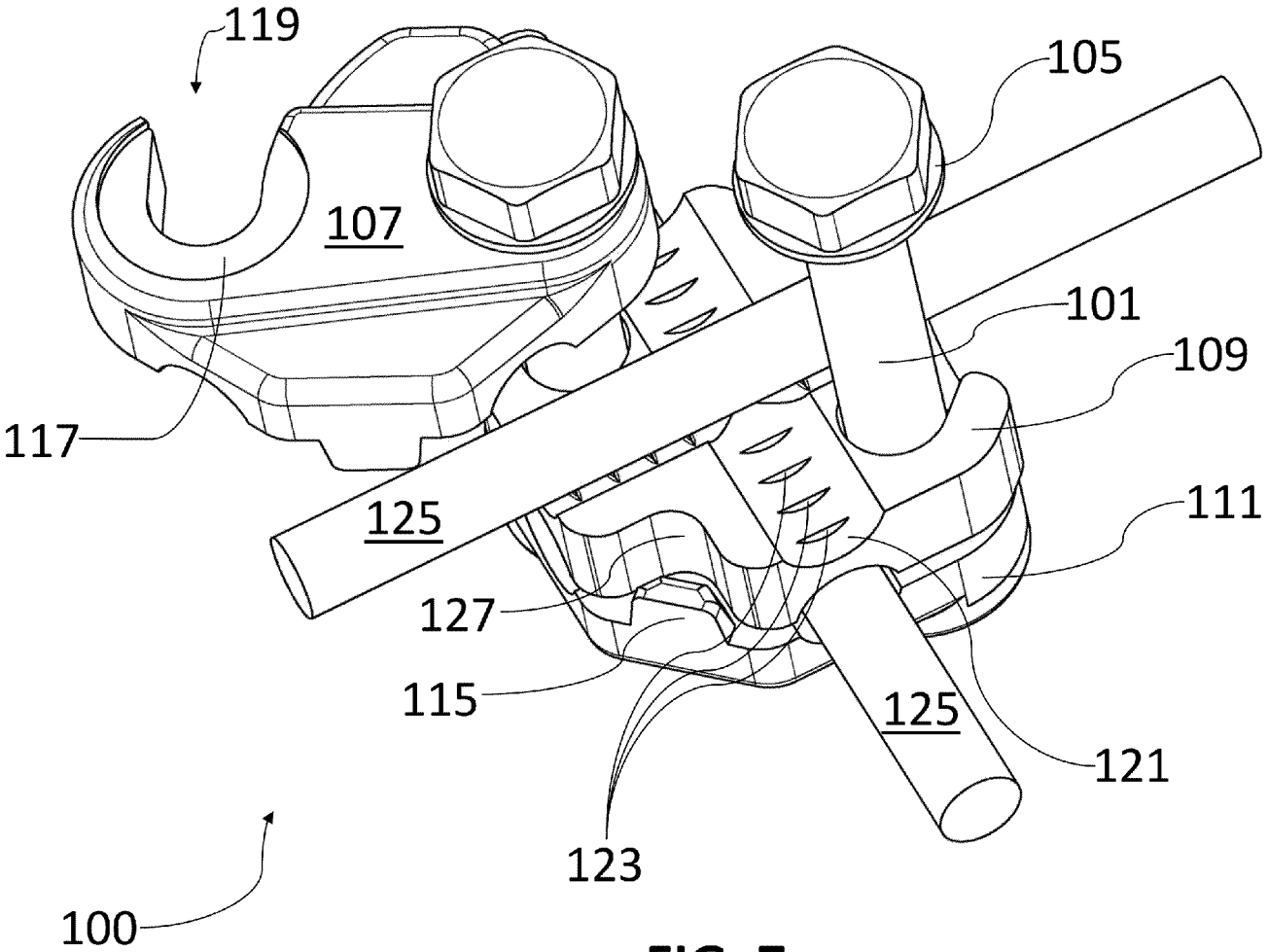
FIG. 7 is a top perspective view of the mechanical grounding connector of the present invention in the open position with two cables being installed.
Figure 8:
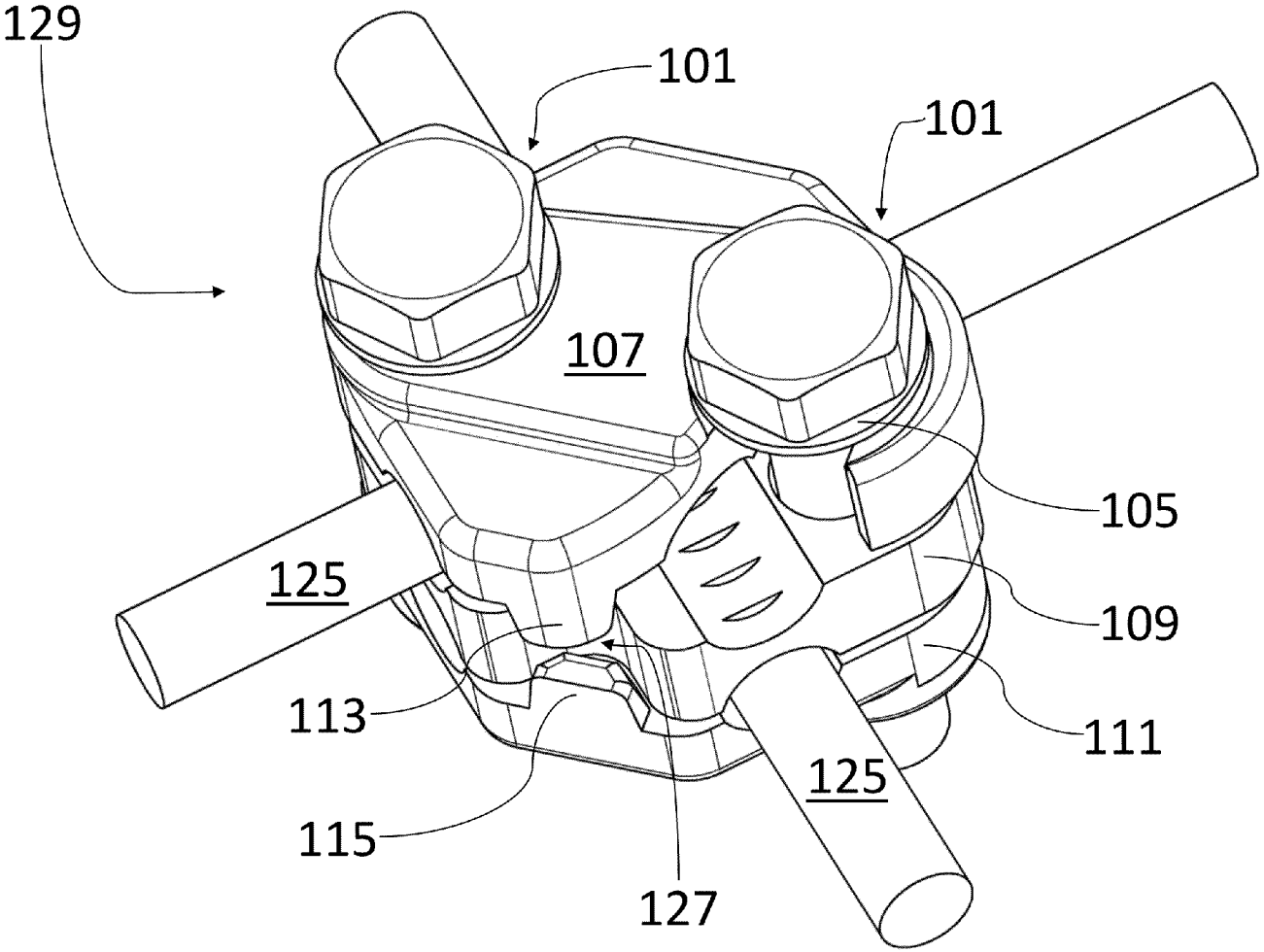
FIG. 8 is a top perspective view of the mechanical grounding connector of the present invention in the closed position with two cables installed in a transverse arrangement.
Figure 9:
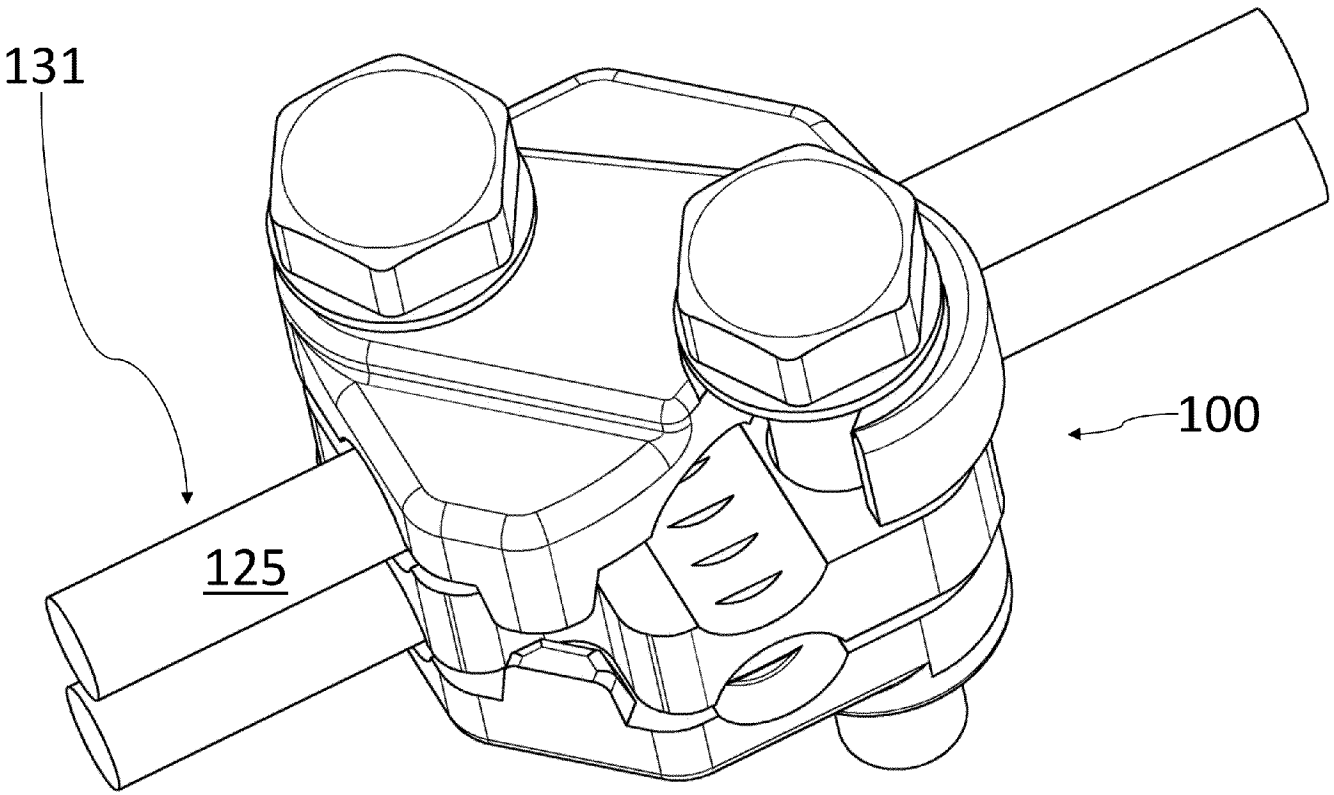
FIG. 9 is a top perspective view of the mechanical grounding connector of the present invention in the closed position with two cables installed in a parallel arrangement.

The conductors 125 are installed in channels 121 which are clearly shown in FIGS. 4 and 5. The channels 121 are recessed into the first body section 107, second body section 109, and third body section 111 of the connector 100. From FIGS. 4 and 5, it can be seen that two channels 121 are recessed into the underside of the first body section 107, two channels 121 are recessed into the top side of the third body section 111, and four channels 121 are recessed into the second body section 109, with two channels being recessed into the top side of the second body section 109 and two channels being recessed into the bottom side of the second body section 109. It is preferred that the channels 121 of each body section cross one another at a 90 degree angle, which allows for conductors 125 to be installed in the connector 100 in either a transverse arrangement 129 or a parallel arrangement 131, as is shown in FIGS. 8 and 9, respectively. It is also preferred that the channels 121 comprise a plurality of ridges 123, which are shown in FIGS. 4-7. These ridges 123 create friction between the installed conductors 125 and the connector 100 in order to prevent slippage of the conductors 125 from the channels 121 of the connector 100 once the bolts 101 are tightened and the connector is in the closed position.

As is shown in FIG. 6, a conductor 125 is first installed between the second body section 109 and the third body section 111 using the channels 121. Once this conductor is in place, the second body section 109 is rotated about the axis which is created by the bolt 101 which has been received through the apertures of each of the body sections, until the slot 119 of the second body section 109 receives the other bolt 101. A second conductor 125 can then be installed between the first body section 107 and the second body section 109 using the channels 121, as is shown in FIG. 7. Once this conductor is in place, the first body section 107 is rotated about the same axis which is formed by the bolt which the body section 109 was rotated, until the slot 119 receives the other bolt 101, as is shown in FIG. 8. After the first body section 107 is in place and the connector is in the closed position, the bolts 101 are each tightened down using a wrench so that the first body section 107, second body section 109, and third body section 111 are locked into place.

In addition to the use of the tightened bolts 101 to keep the body sections of the connector 100 locked into place, locking teeth which are formed as a part of some of the body sections also serve to lock the connector into place. As can be seen in FIGS. 2-5, 8 and 9, the first body section 107 has at least one locking tooth 113 and the third body section 111 has at least one locking tooth 115. These locking teeth engage with a cutout 127 which corresponds in shape to that of the teeth 113 and 115, and which is formed as a part of the second body section 109. When the connector 100 is in the closed position, the teeth 113 and 115 engage with the cutout 127 to keep the first body section 107, second body section 109 and third body section 111 locked into place. It is understood that multiple teeth and cutouts could be formed as a part of each body section or that the arrangement of teeth and cutouts could be changed to different body sections. For instance, the second body section 109 could have teeth formed as a part of that body section, and the first body section 107 and third body section 111 could have corresponding cutouts which engage with the teeth of the second body section 109.

Another feature of the mechanical grounding connector that prevents the body sections from unintentionally separating is the use of a recessed washer space 117, as is clearly shown in FIG. 1 and FIGS. 6 and 7, which is formed as a part of the first body section 107. This recessed washer space 117 allows for the washer 105 to be seated in the recessed space 117 when the first body section 107 is in the closed position and the slot 119 is secured around the bolt 101. The recessed space 117 for the washer 105 prevents the bolt and washer from moving after all of the body sections of the connector 100 have been locked into place.

Figure 10:
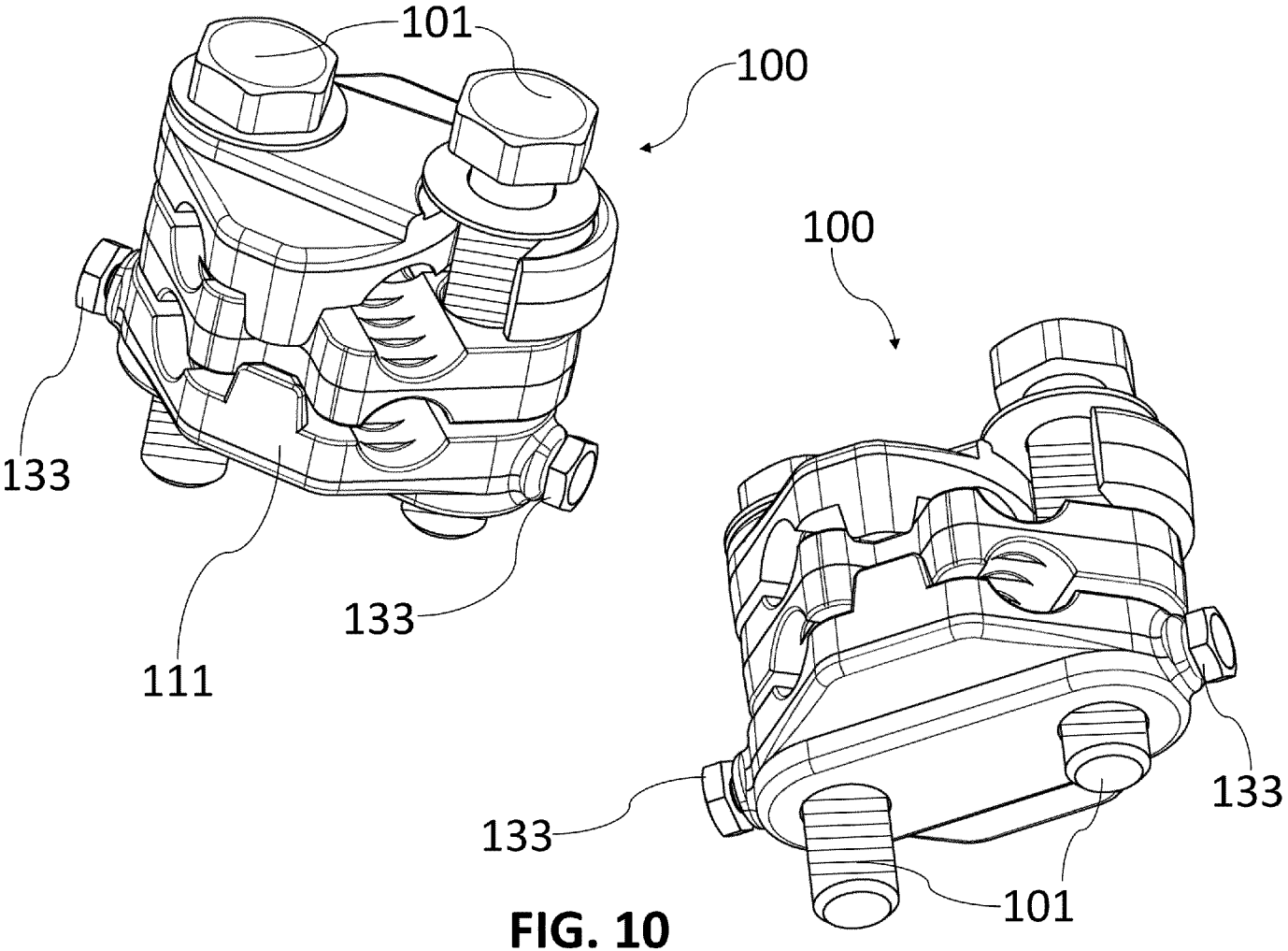
FIG. 10 is a top and bottom perspective view of the mechanical grounding connector of the present invention with locking hex screws.

Show in FIG. 10 is an additional feature of the mechanical grounding connector 100. The additional feature is a set of hex screws 133 which are contained in a body section of the connector 100. In FIG. 10, the hex screws 133 are shown as part of the third body section 111. However, it is understood that the hex screws could be contained within any of the body sections. The hex screws 133 serve as a locking feature for the mechanical grounding connector 100. Once the bolts 101 of the connector are tightened to the desired torque, the hex screws 133 are then tightened and lock the bolts 101 in place by deforming the threads on the bolt. This prevents the bolts 101 from being loosened from the connector 100, which keeps conductors 125, as shown in previous figures, securely installed within the connector 100.

Figure 11:
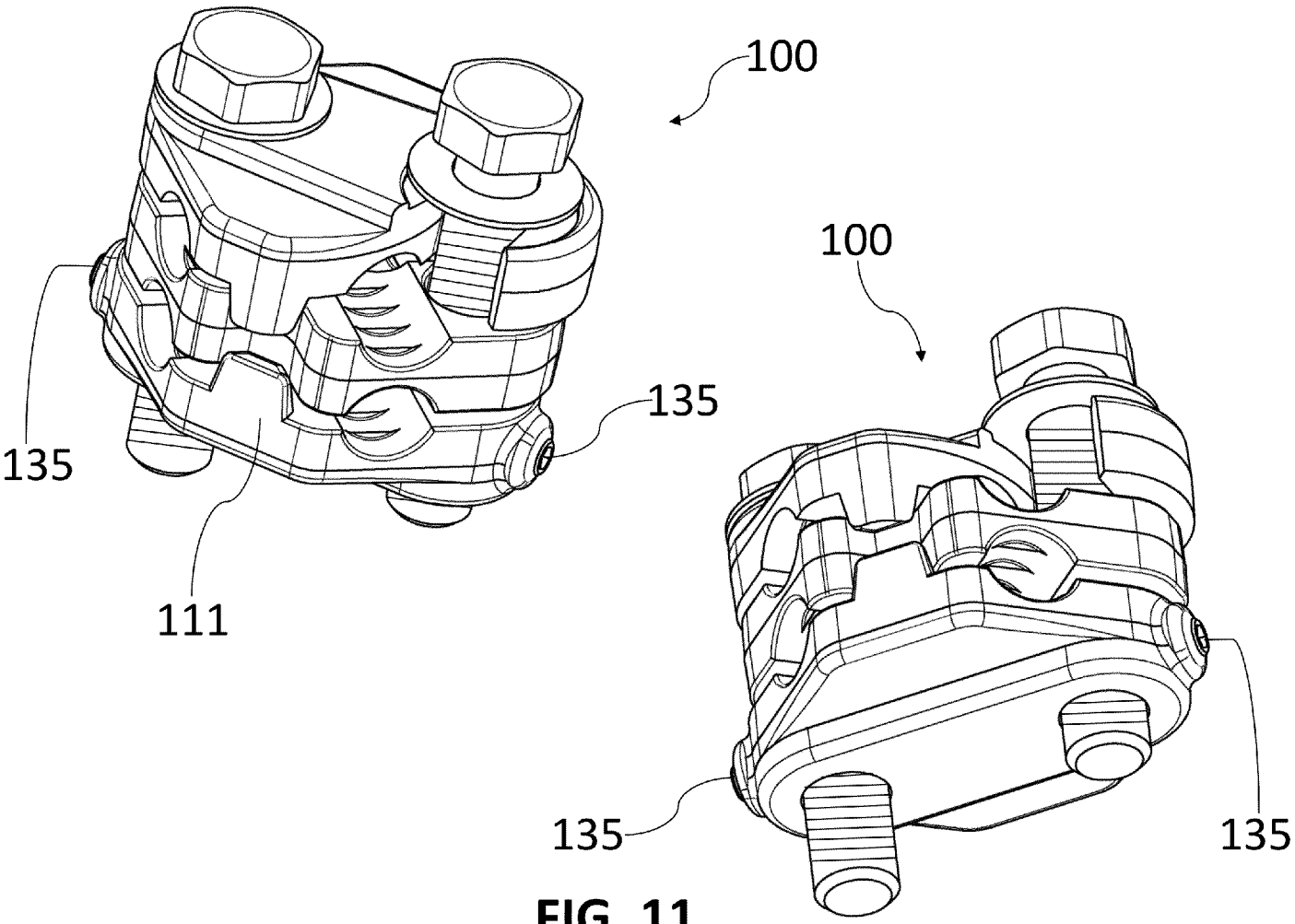
FIG. 11 is a top and bottom perspective view of the mechanical grounding connector of the present invention with locking set screws.

An alternative to the hex screws described in the above paragraph is shown in FIG. 11. In FIG. 11, set screws 135 are used as a locking feature for the mechanical grounding connector 100 which are contained in a body section of the connector 100. In FIG. 11, the set screws are shown as a part of the third body section 111. However, it is understood that the set screws could be contained within any of the body sections. Once the bolts 101 of the connector are tightened to the desired torque, the set screws 135 are then tightened and lock the bolts 101 in place by deforming the threads on the bolt. This prevents the bolts 101 from being loosened from the connector 100, which keeps conductors 125, as shown in previous figures, securely installed within the connector 100.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A grounding connector for mechanically connecting and electrically grounding two conductors together, comprising:
- a first bolt;
- a second bolt;
- a first body section having an open position, a closed position, a first channel for receiving one of the conductors therein, a first aperture for receiving the first bolt therethrough, and a first slot for engaging the second bolt in the closed position;
- a second body section having a second channel for receiving the other conductor therein, and a second aperture and a third aperture for receiving the first bolt and second bolt therethrough;
- wherein when the first body section is in the open position, the two conductors can be configured in parallel or transversely without reorienting the first and second body sections and are mechanically connected and electrically grounded when the first body section is in the closed position; and
- wherein the grounding connector comprises a third body section having a fourth and a fifth aperture for receiving the first and second bolts, respectively, and wherein one of the conductors is situated in the first channel between the first body section and the second body section and wherein the other conductor is situated in the second channel between the second body section and the third body section.

2. The grounding connector of claim 1 wherein the grounding connector further comprises a pair of hex screws in at least one of the body sections which, when tightened, deform threads of the first and second bolt such that the bolts are locked into position.

3. The grounding connector of claim 1 wherein the grounding connector further comprises a pair of set screws in at least one of the body sections which, when tightened, deform threads of the first and second bolt such that the bolts are locked into position.

4. The grounding connector of claim 1 wherein the first channel and the second channel comprise a plurality of channel ridges to create friction between the conductors and the channels in order to prevent slippage of the conductors from the channels of the connector when the connector is in the closed position.

5. The grounding connector of claim 1, wherein the first and second bolt are stainless steel bolts and wherein the first and second and third body sections of the connector are made from silicon bronze.

6. A grounding connector for mechanically connecting and electrically grounding two conductors together, comprising:

a first body section;

a second body section;

a third body section;

at least two bolts;

wherein the first, second and third body sections each comprise at least two recessed channels;

wherein the first, second and third body sections each comprise at least two apertures or slots;

wherein the at least two apertures or slots of each of the body sections can be aligned with the apertures or slots of the other body sections such that the at least two bolts can be received simultaneously through the at least two apertures or slots of the first, second and third body sections, respectively, to form the connector;

wherein the at least two bolts are not required to be removed from the connector in order for the connector to be in the open position, but can be loosened such that the first, second and third body sections swing out and rotate about a vertical axis which is created by one of the at least two bolts to allow installation of the at least two conductors within the recessed channels of the body sections by installing one of the at least two conductors between the first and second body sections and by installing another of the at least two conductors between the second and third body sections; and wherein the at least two bolts can be tightened when the connector is in the closed position in order to secure the at least two conductors between the first, second and third body sections within the connector.

7. The grounding connector of claim 6, wherein the at least two recessed channels of each of the body sections comprise a plurality of channel ridges to create friction between the installed conductors and the connector in order to prevent slippage of the conductors from the channels of the connector when the connector is in the closed position.

8. The grounding connector of claim 6, wherein the at least two recessed channels of each of the body sections cross one another transversely so that the conductors can be installed between the respective body sections of the connector in a parallel or transverse arrangement.

9. The grounding connector of claim 6, wherein the at least two recessed channels of the first body section are recessed on the underside of the first body section, wherein the at least two recessed channels of the second body section are at least four recessed channels with two channels being recessed on the top side of the second body section and two channels being recessed on the underside of the second body section, and wherein the at least two recessed channels of the third body section are recessed on the top side of the third body section.

10. The grounding connector of claim 6, wherein the at least two bolts are stainless steel bolts and wherein the first, second and third body sections of the connector are made from silicon bronze.

11. The grounding connector of claim 6, wherein the first and third body sections each have at least one locking tooth, and wherein the second body section has a cutout which can engage the locking teeth of the first and third body sections so that all of the body sections are locked together when the at least two bolts are tightened.

12. The grounding connector of claim 6, wherein the second body section has at least two locking teeth, one projecting upward and one projecting downward, and wherein the first and third body sections each have a cutout which can engage the locking teeth of the second body section so that all of the body sections are locked together when the at least two bolts are tightened.

13. The grounding connector of claim 6, wherein washers are used in conjunction with the at least two bolts, and wherein the first body section has a recessed washer space for at least one of the washers to lock the washer into place when the bolts are tightened so that the first, second and third body sections are securely held together when the bolts are tightened.

14. The grounding connector of claim 6 wherein the grounding connector further comprises a pair of hex screws in at least one of the body sections which, when tightened, deform threads of the at least two bolts such that the bolts are locked into position.

15. The grounding connector of claim 6 wherein the grounding connector further comprises a pair of set screws in at least one of the body sections which, when tightened, deform threads of the at least two bolts such that the bolts are locked into position.

16. A grounding connector for mechanically connecting and electrically grounding two conductors together, comprising:

a first body section;

a second body section;

a third body section;

at least two bolts;

wherein the first, second and third body sections each comprise at least two recessed channels which cross one another transversely so that the conductors can be installed in a parallel or transverse arrangement;

wherein the first, second and third body sections each comprise at least two apertures or slots;

wherein the at least two apertures or slots of each of the body sections can be aligned with the apertures or slots of the other body sections such that the at least two bolts can be received simultaneously through the at least two apertures or slots of the first, second and third body sections, respectively, to form the connector;

wherein the at least two bolts are not required to be removed from the connector in order for the connector to be in the open position, but can be loosened such that the first, second and third body sections swing out and rotate about a vertical axis which is created by one of the at least two bolts to allow installation of the at least two conductors within the recessed channels of the body sections by installing one of the at least two conductors between the first and second body sections and by installing another of the at least two conductors between the second and third body sections; and wherein the at least two bolts can be tightened when the connector is in the closed position in order to secure the at least two conductors between the first, second and third body sections within the connector.

17. The grounding connector of claim 16, wherein the at least two recessed channels of each of the body sections comprise a plurality of channel ridges to create friction between the installed conductors and the connector in order to prevent slippage of the conductors from the channels of the connector when the connector is in the closed position.

18. The grounding connector of claim 16, wherein the at least two recessed channels of the first body section are recessed on the underside of the first body section, wherein the at least two recessed channels of the second body section are at least four recessed channels with two channels being recessed on the top side of the second body section and two channels being recessed on the underside of the second body section, and wherein the at least two recessed channels of the third body section are recessed on the top side of the third body section.

19. The grounding connector of claim 16, wherein the at least two bolts are stainless steel bolts and wherein the first, second and third body sections of the connector are made from silicon bronze.

20. The grounding connector of claim 16, wherein the first and third body sections each have at least one locking tooth, and wherein the second body section has a cutout which can engage the locking teeth of the first and third body sections so that all of the body sections are locked together when the at least two bolts are tightened.

21. The grounding connector of claim 16, wherein the second body section has at least two locking teeth, one projecting upward and one projecting downward, and wherein the first and third body sections each have a cutout which can engage the locking teeth of the second body section so that all of the body sections are locked together when the at least two bolts are tightened.

22. The grounding connector of claim 16, wherein washers are used in conjunction with the at least two bolts, and wherein the first body section has a recessed washer space for at least one of the washers to lock the washer into place when the bolts are tightened so that the first, second and third body sections are securely held together when the bolts are tightened.

23. The grounding connector of claim 16 wherein the grounding connector further comprises a pair of hex screws in at least one of the body sections which, when tightened, deform threads of the at least two bolts such that the bolts are locked into position.

24. The grounding connector of claim 16 wherein the grounding connector further comprises a pair of set screws in at least one of the body sections which, when tightened, deform threads of the at least two bolts such that the bolts are locked into position.

* * * * *